US007914128B2

(12) United States Patent
Fujita

(10) Patent No.: US 7,914,128 B2
(45) Date of Patent: Mar. 29, 2011

(54) LIQUID EJECTING HEAD, PIEZOELECTRIC ELEMENT, AND LIQUID EJECTING APPARATUS

(75) Inventor: Seiichi Fujita, Shiojiri (JP)

(73) Assignee: Sieko Epson Corporation, Shinjuku-ku, Tokyo (JP)

( * ) Notice: Subject to any disclaimer, the term of this patent is extended or adjusted under 35 U.S.C. 154(b) by 183 days.

(21) Appl. No.: 12/413,422

(22) Filed: Mar. 27, 2009

(65) Prior Publication Data

US 2009/0244214 A1 Oct. 1, 2009

(30) Foreign Application Priority Data

Mar. 28, 2008 (JP) ..... 2008-088176
Jan. 8, 2009 (JP) ..... 2009-002958

(51) Int. Cl.
*B41J 2/045* (2006.01)

(52) U.S. Cl. ..... 347/71

(58) Field of Classification Search ..... 347/71, 347/70, 72, 68–69; 400/124.14, 124.16; 310/311, 324, 327, 365
See application file for complete search history.

(56) References Cited

U.S. PATENT DOCUMENTS 6,929,355 B2 * 8/2005 Matsuzawa ..... 347/71
7,018,023 B2 * 3/2006 Shimada ..... 347/71
7,481,519 B2 * 1/2009 Shimada et al. ..... 347/70

FOREIGN PATENT DOCUMENTS

JP 2000-246888 A 9/2000
JP 2007-118193 A 5/2007
JP 2007-261216 A 10/2007
JP 2007-281033 A 10/2007
JP 2008-044385 A 2/2008

* cited by examiner

*Primary Examiner* — K. Feggins
(74) *Attorney, Agent, or Firm* — Kilpatrick Townsend & Stockton LLP

(57) ABSTRACT

A liquid ejecting head includes a piezoelectric element in which a lower electrode, a piezoelectric layer, and an upper electrode are laminated in this order, and a flow path forming substrate in which the piezoelectric element is formed above one surface thereof and a pressure generating chamber being communicated with a nozzle opening is provided, in which the upper electrode is formed so as to extend over an upper surface of the piezoelectric layer and an upper portion of side faces of the piezoelectric layer, and a protective film is formed above portions of the piezoelectric layer, which are not covered by the upper electrode.

5 Claims, 4 Drawing Sheets

LIQUID EJECTING HEAD, PIEZOELECTRIC ELEMENT, AND LIQUID EJECTING APPARATUS

This application claims priority to Japanese Patent Application No. 2008-088176 filed on Mar. 28, 2008 and Japanese Patent Application No. 2009-002958, filed on Jan. 8, 2009, the entire disclosures of which are expressly incorporated by reference herein.

BACKGROUND

1. Technical Field

The present invention relates to a liquid ejecting head, a piezoelectric element, and a liquid ejecting apparatus.

2. Related Art

As an example of a liquid ejecting head, an ink ejecting recording head in which a piezoelectric element consisting of an upper electrode, a piezoelectric layer, and a lower electrode is used as a pressure generating unit is known (reference should be made to, for example, claim 2 and FIG. 6 of JP-A-2000-246888). In such an ink ejecting recording head, an insulation layer for preventing moisture degradation of the piezoelectric layer is formed in a state of covering the piezoelectric layer and the upper electrode.

According to the above-mentioned configuration, although it is possible to obtain a sufficiently large displacement amount in response to driving of the piezoelectric element and excellent ink ejection characteristics, there is a pending need to further increase the displacement amount.

SUMMARY

An advantage of some aspects of the invention is that it provides a piezoelectric element capable of providing a large displacement amount and a liquid ejecting head using the piezoelectric element. Another advantage of some aspects of the invention is that it provides a liquid ejecting apparatus equipped with the liquid ejecting head, capable of exhibiting excellent printing quality.

According to an aspect of the invention, there is provided a liquid ejecting head including: a piezoelectric element in which a lower electrode, a piezoelectric layer, and an upper electrode are laminated in this order; and a flow path forming substrate in which the piezoelectric element is formed above one surface thereof and a pressure generating chamber being communicated with a nozzle opening is provided, in which the upper electrode is formed so as to extend over an upper surface of the piezoelectric layer and an upper portion of side faces of the piezoelectric layer, and a protective film is formed above portions of the piezoelectric layer, which are not covered by the upper electrode.

Since the upper electrode of the piezoelectric element is formed so as to extend over the upper surface of the piezoelectric layer and the upper portion of the side faces of the piezoelectric layer, it is possible to increase the area where electric field is produced during driving of the piezoelectric element. Moreover, since the protective film is not configured to cover an entire of the piezoelectric element but is configured to cover only the portions of the piezoelectric layer, which are not covered by the upper electrode, the possibility that the movement of the piezoelectric layer is inhibited by the protective film is low. Therefore, according to the configuration, it is possible to further increase the displacement amount in response to driving of the piezoelectric element. In this case, since the piezoelectric layer is covered by the upper electrode and the protective film, it is possible to prevent degradation thereof due to moisture.

In the above aspect of the liquid ejecting head of the invention, a width of the piezoelectric layer may increase toward the lower electrode, a thickness of a portion of the upper electrode formed above the side faces may gradually decrease toward the lower electrode, and the protective film may be provided so as to overlap with the gradually decreasing thickness portion of the upper electrode. If the side faces of the piezoelectric layer are sloped surfaces, electric field can be produced over a wide range of areas when the upper electrode is configured to cover the upper surface and the side faces of the piezoelectric layer. Therefore, it is possible to further increase the displacement amount in response to driving of the piezoelectric element. Moreover, the portion of the upper electrode formed above the side faces has a width thereof which gradually decreases toward the lower portions of the side faces, and the protective film is provided so as to overlap with the gradually decreasing thickness portion of the upper electrode. Therefore, the protective film is easily adhered onto the piezoelectric layer, and thus the degradation of the piezoelectric element can be prevented.

In the above aspect of the liquid ejecting head of the invention, the upper electrode may be configured to cover an upper half portion of each of the side faces of the piezoelectric layer. Owing to such a configuration, it is not only possible to prevent the upper electrode and the lower electrode from making contact with each other to be shorted but also to further increase the displacement amount.

According to another aspect of the invention, there is provided a piezoelectric element including: a lower electrode formed above a substrate; a piezoelectric layer formed above the lower electrode; and an upper electrode that covers an upper surface of the piezoelectric layer and an upper portion of side faces of the piezoelectric layer, in which a protective film is formed above portions of the piezoelectric layer, which are not covered by the upper electrode. In such a piezoelectric element, it is possible to further increase the displacement amount.

According to a further aspect of the invention, there is provided a liquid ejecting apparatus including the liquid ejecting head according to the above aspect of the invention. Since the liquid ejecting apparatus is equipped with the liquid ejecting head having good ink ejection characteristics, the printing characteristics of the liquid ejecting apparatus can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
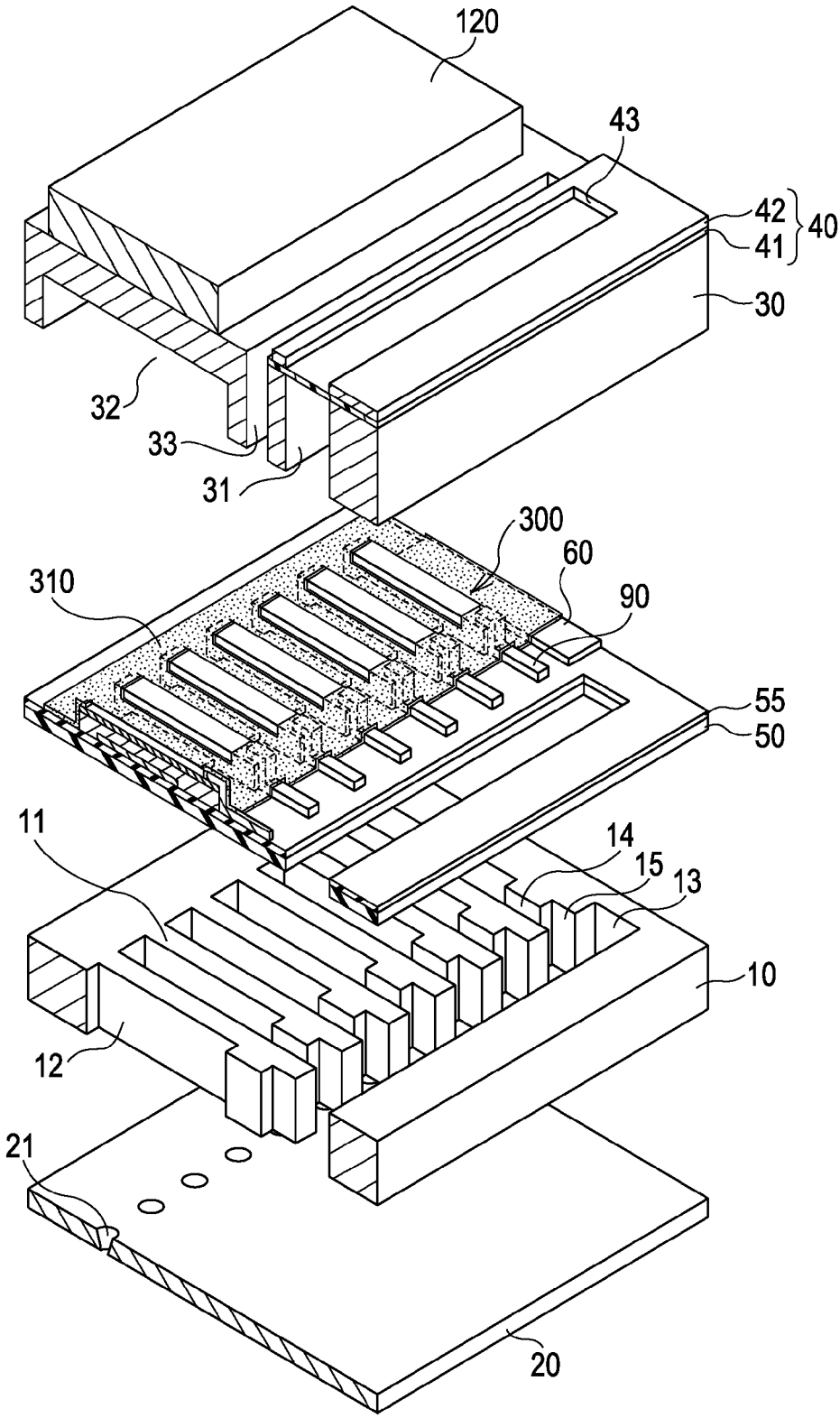
FIG. 1 is an exploded perspective view of a recording head according to an embodiment of the invention.
Figure 2A:
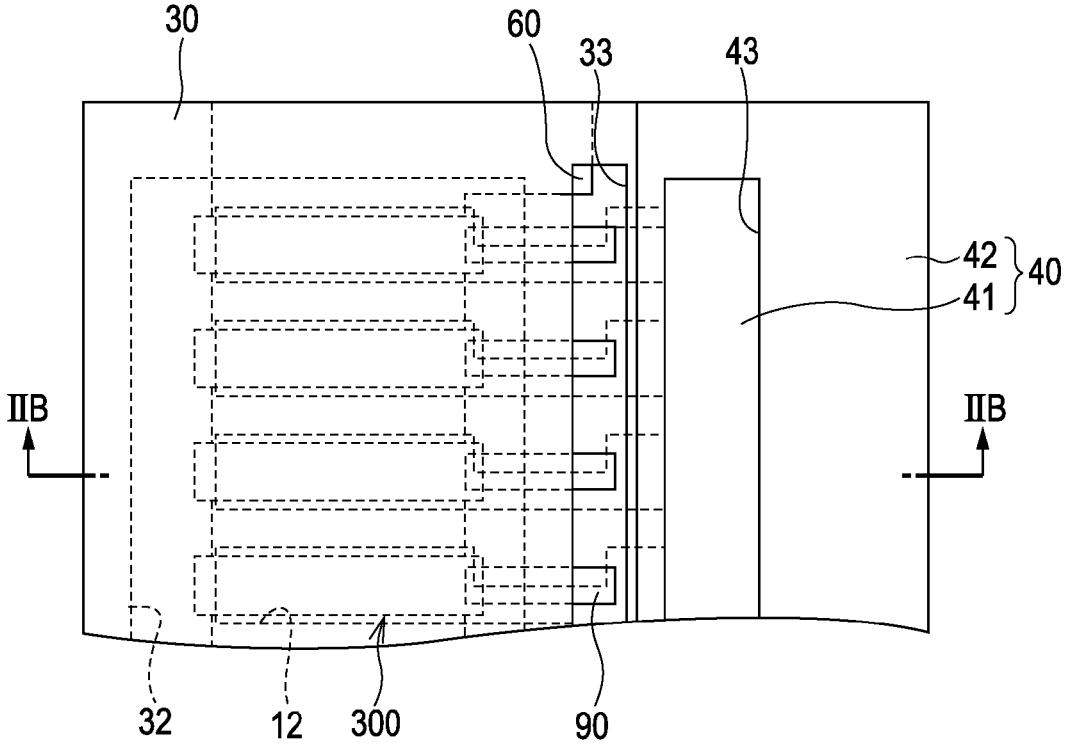
FIGS. 2A and 2B are a top plan view and a sectional view of the recording head according to the embodiment of the invention, respectively.
Figure 2B:
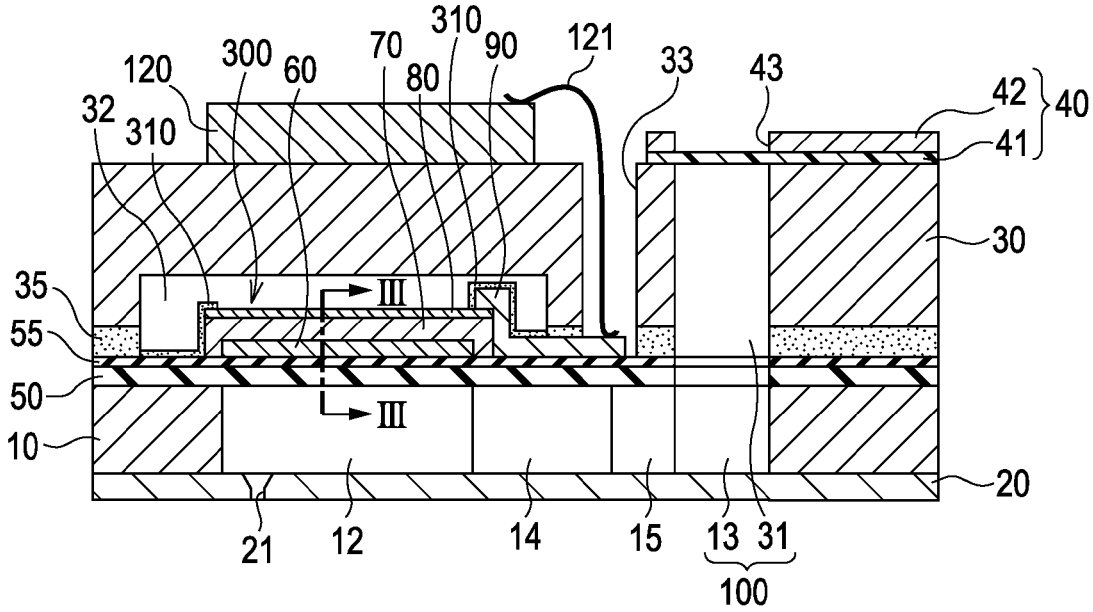

Exemplary embodiments will be described herein below with reference to the accompanying drawings. FIG. 1 is an exploded perspective view showing a simplified structure of an ink ejecting recording head which is an example of a liquid ejecting head according to the present embodiment. FIG. 2A is a top plan view of FIG. 1, and FIG. 2B is a sectional view taken along the line IIA-IIA' in FIG. 2A. For better understanding of the drawing, a later-described protective film 310 is not depicted in FIG. 2A.

A flow path forming substrate 10 is formed of a single crystal silicon substrate which has a plane (110) of the plane orientation in the present embodiment. An elastic film 50 which is preliminarily formed of silicon dioxide by thermal oxidation is formed on one surface of the flow path forming substrate 10. An insulation film 55 formed of zirconium oxide ($ZrO_2$) or the like is formed on the elastic film 50. On the other surface of the flow path forming substrate 10, pressure generating chambers 12 which are partitioned by a plurality of partition walls 11 are arranged in a width direction thereof (short-axis direction) by anisotropically etching from the other surface. A communicating portion 13 is formed in an outer region in the longitudinal direction of the pressure generating chambers 12 of each row, and the communicating portion 13 and each of the pressure generating chambers 12 are communicated with each other via an ink supply path 14 and a communicating path 15 which are provided for each of the pressure generating chambers 12. That is, in the flow path forming substrate 10, the pressure generating chamber 12, the communicating portion 13, the ink supply path 14, and the communicating path 15 are formed as a liquid flow path.

The communicating portion 13 is communicated with a reservoir portion 31 of a later-described protective substrate 30, thereby constituting a portion of a reservoir 100 which serves as a common ink chamber for the rows of the pressure generating chambers 12. The ink supply path 14 is formed with a width narrower than that of the pressure generating chambers 12, and is configured to keep constant flow path resistance of ink flowing from the communicating portion 13 into the pressure generating chambers 12. In the present embodiment, although the ink supply path 14 is formed by narrowing the width of one of the pressure generating chamber 12 and the communicating path 15, the invention is not particularly limited to this. For example, the ink supply path 14 may be formed by narrowing the width of both the pressure generating chamber 12 and the communicating path 15, and the ink supply path 14 may be formed by narrowing the size in a thickness direction thereof.

Onto the opening surface (the other surface) of the flow path forming substrate 10 where an opening is formed, a nozzle plate 20 having nozzle openings 21 bored therein which are communicated with a zone near the end portions of the pressure generating chambers 12 on the side opposite to the liquid supply paths 14 is fixedly secured by an adhesive or a heat welding film.

On the insulation film 55, a lower electrode 60, a piezoelectric layer 70 formed of lead zirconate titanate (PZT), which is an example of a piezoelectric film, and an upper electrode 80 are formed in a laminated state, thereby constituting a piezoelectric element 300. The piezoelectric element 300 refers to a portion including the lower electrode 60, the piezoelectric layer 70, and the upper electrode 80. The piezoelectric element 300 functions as a pressure generating element that causes a pressure change to the ink (liquid) in the pressure generating chamber 12.

In the present embodiment, the lower electrode 60 of the piezoelectric element 300 is used as a common electrode, the upper electrode 80 is used as an individual electrode of the piezoelectric element 300, so that the piezoelectric layer 70 is driven by electric voltage applied between the upper electrode 80 and the lower electrode 60. The piezoelectric layer 70 is formed of a piezoelectric material which is formed on the lower electrode 60 and exhibits electromechanical conversion action, and among the piezoelectric materials, a ferroelectric material having the Perovskite structure.

Figure 3:
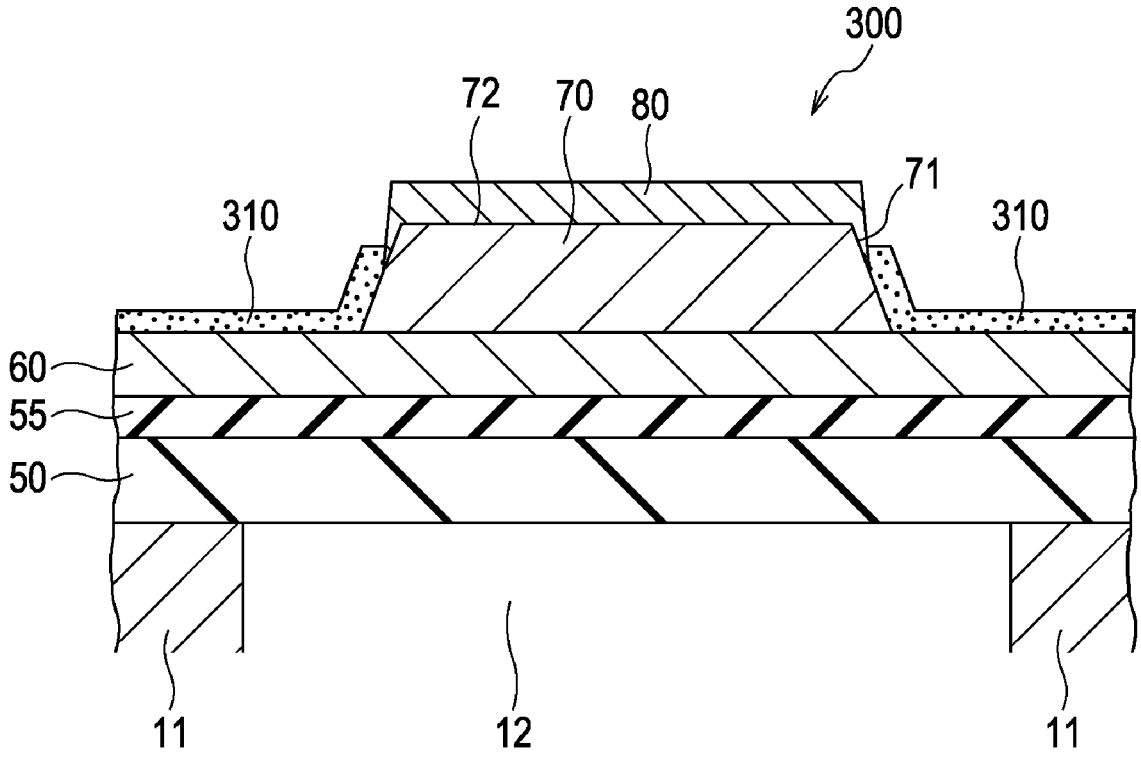
FIG. 3 is a sectional view of the recording head according to the embodiment of the invention.

A structure of the piezoelectric element 300 will be described in detail with reference to FIG. 3. FIG. 3 is a main part sectional view for explaining the structure of the piezoelectric element 300 and is a sectional view taken along the line IIB-IIB' in FIG. 2B. The piezoelectric layer 70 on the lower electrode 60 which is the common electrode is patterned by anisotropic etching so that a width thereof increases toward the lower electrode 60. That is, the piezoelectric layer 70 has sloped side faces 71. An upper side of both side faces 71 and an upper surface 72 of the piezoelectric layer 70 are covered by the upper electrode 80. In this manner, since the upper electrode 80 covers not only the upper surface 72 of the piezoelectric layer 70 but also the upper portion of the side faces 71, when electric voltage is applied between the upper electrode 80 and the lower electrode 60, it is possible to produce electric field over a wider range of areas of the piezoelectric layer 70 than that in the case where the upper electrode 80 is formed in only the upper surface 72. Therefore, it is possible to further increase the displacement amount of the piezoelectric element 300.

In order to protect the portion of the side faces 71 of the piezoelectric layer 70 which is not covered by the upper electrode 80, that is, the lower portion of the side faces 71, from moisture, a protective film 310 functioning as a moisture-resistant protective film is provided. The protective film 310 is formed, for example, of an oxide film such as aluminum oxide or an organic film such as polyimide. In this manner, in the present embodiment, since the side faces 71 of the piezoelectric layer 70 are covered by the upper electrode 80 and the protective film 310, it is possible to prevent degradation of the piezoelectric layer 70 due to moisture. In this case, it is preferable that the protective film 310 is provided to extend a wide range of areas of the upper surface of the insulation film 55 as shown in FIG. 1 so that moisture cannot make contact with the piezoelectric layer 70. Moreover, since the protective film 310 is not configured to cover an entire of the side faces 71 among the surface of the piezoelectric layer 70 but is configured to cover only the lower portion of the side faces 71, which are not covered by the upper electrode 80, the movement thereof during the driving of the piezoelectric element 300 is not inhibited, and thus, it is possible to further increase the displacement amount of the piezoelectric layer 70.

Moreover, it is preferable that the portion of the upper electrode 80 covering the side faces 71 has a thickness thereof which gradually decreases toward the lower portion of the side faces 71, and the gradually decreasing thickness portion overlaps with the protective film 310. Owing to such a configuration, since the protective film 310 is easily adhered onto the piezoelectric element 300, it is possible to prevent the piezoelectric element 300 from making contact with the atmosphere to be degraded due to moisture, which results from the poor adhesion of the protective film 310. The upper electrode 80 is preferably configured to cover the upper half portion of the side faces 71. Although it is preferable that the upper electrode 80 covers a wide range of areas of the side faces 71 as much as possible in order to increase the displacement amount, there is a fear that the upper electrode 80 is shorted to the lower electrode 60 when they are brought into contact with each other. Therefore, when the upper electrode 80 is configured to cover the upper half portion of the side faces 71, it is possible to obtain a sufficient displacement amount with no fear of short-circuits.

Such a piezoelectric element 300 is constructed in such a manner that the lower electrode 60 and the piezoelectric layer 70 are formed in this order by film forming and patterning processes and thereafter, the upper electrode 80 is formed thereon by film forming and patterning processes. Thereafter, a later-described lead electrode 90 is formed, and the protective film 301 is provided at a predetermined position, whereby the piezoelectric element according to the present embodiment is provided.

The upper electrodes 80 which are the individual electrodes of the piezoelectric element 300 are connected to the lead electrodes 90 which are formed, for example, of gold (Au) and are led out from the vicinity of the end portions close to the ink supply path 14 to be extended to be positioned on the insulation film 55. In the above-described example, although the elastic film 50 and the insulation film 55 function as the vibration plate, either one of the elastic film 50 or the insulation film 55 may be provided as the vibration plate.

On the flow path forming substrate 10 where the piezoelectric elements 300 are formed, that is, on the lower electrode 60, the insulation film 55, and the lead electrode 90, a protective substrate 30 having a reservoir portion 31 constituting at least a portion of the reservoir 100 is bonded via an adhesive 35. In the present embodiment, the reservoir portion 31 is provided along the width direction of the pressure generating chambers 12 so as to penetrate through the protective substrate 30 in a thickness direction thereof. The reservoir portion 31 is communicated with the communicating portion 13 of the flow path forming substrate 10, thereby constituting the reservoir 100 which serves as a common ink chamber for the respective pressure generating chambers 12. Moreover, the communicating portion 13 of the flow path forming substrate 10 may be divided into a plurality of parts which correspond to the pressure generating chambers 12, so that the reservoir is constituted by only the reservoir portion 31. Furthermore, only the pressure generating chambers 12 may be provided in the flow path forming substrate 10, and the ink supply path 14 may be provided to the member (for example, the elastic film 50, the insulation film 55, and the like) disposed between the flow path forming substrate 10 and the protective substrate 30 so as to be communicated with the reservoir and the respective pressure generating chambers 12.

The protective substrate 30 has a piezoelectric element holding portion 32 which is defined in a region of the protective substrate 30 opposed to the piezoelectric element 300 and has such a space that the movement of the piezoelectric element 300 is not inhibited. As long as the space of the piezoelectric element holding portion 32 does not inhibit the movement of the piezoelectric element 300, the space may be, or may not be, hermetically sealed.

In the protective substrate 30, a through-hole 33 is bored so as to penetrate through the protective substrate 30 in the thickness direction thereof. The lead electrodes 90 which are led out from the respective piezoelectric elements 300 have the distal ends thereof being exposed to the inside of the through-hole 33.

On the protective substrate 30, a driving circuit 120 for driving the piezoelectric elements 300 is fixedly secured. As the driving circuit 120, a circuit board or a semiconductor integrated circuit (IC), for example, can be used. The driving circuit 120 and the lead electrode 90 are electrically connected to each other via a connection wiring 121 which is inserted through the through-hole 33 and is configured by a conductive wire such as a bonding wire.

Preferably, the protective substrate 30 is formed of a material having approximately the same thermal expansion coefficient as that of the flow path forming substrate 10, such as, glass or a ceramic material. In the present embodiment, the protective substrate 30 is formed using a single crystal silicon substrate which has a plane (110) of the plane orientation and is formed of the same material as that of the flow path forming substrate 10.

Furthermore, a compliance plate 40, which consists of a sealing film 41 and a fixing plate 42, is bonded onto the protective substrate 30. The sealing film 41 is formed of a material having a low rigidity and flexibility (for example, a polyphenylene sulfide (PPS) film), and the sealing film 41 seals one surface of the reservoir portion 31. The fixing plate 42 is formed of a hard material such as a metal (for example, stainless steel (SUS)). A region of the fixing plate 42 opposed to the reservoir 100 defines an opening portion 43 which is completely deprived of the plate in the thickness direction. Thus, one surface of the reservoir 100 is sealed only with the sealing film 41 having flexibility.

In the ink ejecting recording head of the present embodiment, ink is taken in from a non-illustrated external ink supply unit, and the interior of the head ranging from the reservoir 100 to the nozzle openings 21 is filled with the ink. Then, according to recording signals from the drive IC 210, voltage is applied between the lower electrode film 60 and the upper electrode film 80 corresponding to each of the pressure generating chambers 12 to warp and deform the elastic film 50, the insulation film 55, the lower electrode 60, and the piezoelectric layer 70. As a result, the pressure in each of the pressure generating chambers 12 rises, and thus ink is ejected from the nozzle openings 21.

In this case, in the ink ejecting recording head according to the present embodiment, the upper electrode 80 is formed so as to cover the upper surface 72 of the piezoelectric layer 70 and the upper portion of the side faces 71 of the piezoelectric layer 70, and the protective film 310 is provided so as to cover only the lower portion of the side faces 71 of the piezoelectric layer 70. When electric voltage is applied between the lower electrode 60 and the upper electrode 80, since it is possible to further increase the displacement amount of the piezoelectric element 300, a desired amount of ink droplets can be ejected.

Figure 4:
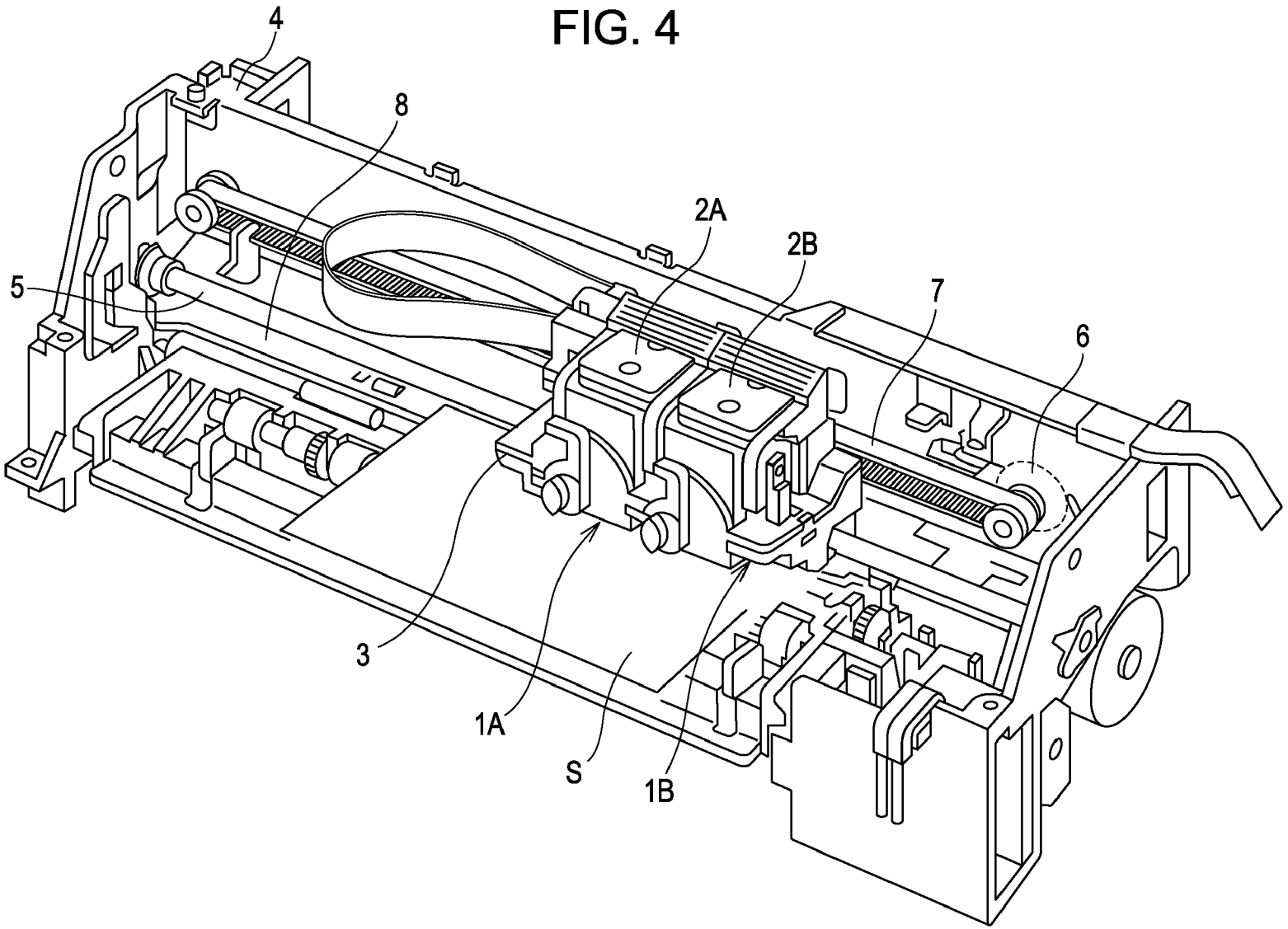
FIG. 4 is a schematic view showing an example of a recording apparatus according to the embodiment of the invention.

The above-described ink ejecting recording head constitutes a portion of the recording head unit provided with an ink flow path being communicated with an ink cartridge or the like and is mounted on the ink ejecting recording apparatus. FIG. 4 is a schematic view showing an example of the ink ejecting recording apparatus. As illustrated in the drawing, recording head units 1A and 1B, which have ink ejecting recording heads, respectively, are provided so as to be respectively detachably attached to cartridges 2A and 2B which form an ink supply unit, and a carriage 3 mounting thereon the recording head units 1A and 1B is axially movably provided to a carriage shaft 5 which is attached to an apparatus body 4. The recording head units 1A and 1B are configured to eject, for example, black ink composition and color ink composition, respectively.

When a driving force of a driving motor 6 is transferred to the carriage 3 via a plurality of non-illustrated gears and a timing belt 7, the carriage 3 mounting thereon the recording head units 1A and 1B is moved along the carriage shaft 5. On the other hand, a platen 8 is provided to the apparatus body 4 along the carriage shaft 5 so that a recording sheet S which is a recording medium such as paper fed by a non-illustrated feed roller or the like is transported on the platen 8.

In the ink ejecting recording apparatus according to the present embodiment, since the above-described ink ejecting recording head is used in the recording head units 1A and 1B, the ink ejection characteristics thereof are excellent, and thus excellent printing characteristics can be provided.

While an exemplary embodiment of the invention has been described, the invention is not limited to the above-described embodiment. For example, although a single crystal silicon substrate has bee illustrated as the flow path forming substrate 10, the invention is not particularly limited to this. For example, a SOI substrate, a glass substrate, a MgO substrate, and the like can be effectively used in the invention.

Furthermore, in the above-described embodiments, the ink ejecting recording head is taken for illustration as an example of the liquid ejecting head. However, the invention is aimed to broadly cover the overall liquid ejecting head and, needless to say, can be applied to liquid ejecting heads for ejecting liquid other than ink. Examples of other liquid ejecting heads include a variety of types of recording heads for use in an image recording apparatus such as a printer, a coloring-material ejecting head for use in manufacture of a color filter of a liquid crystal display or the like, an electrode-material ejecting head for use in forming an electrode of an organic EL display, an FED (field emission display) or the like, a bioorganic-material ejecting head for use in manufacture of a biochip, and the like.

Moreover, in the above-described ink ejecting recording apparatus, although the head units 1A and 1B are illustrated as being mounted on the carriage 3 to be moved in the main scanning direction, the invention is not particularly limited to this. For example, the invention may be applied to a so-called line type recording apparatus in which the ink ejecting recording head (or the head unit) may be fixedly secured, and only the recording sheet S such as paper is moved in the sub-scanning direction, whereby printing is performed thereon. Furthermore, although the ink ejecting recording apparatus has been described as an example of the liquid ejecting apparatus, the invention can be similarly applied to a liquid ejecting apparatus using the above-mentioned other liquid ejecting heads.

What is claimed is:

1. A liquid ejecting head comprising:

a piezoelectric element in which a lower electrode, a piezoelectric layer, and an upper electrode are laminated in this order; and a flow path forming substrate in which the piezoelectric element is formed above one surface thereof and a pressure generating chamber being communicated with a nozzle opening is provided, wherein the upper electrode is formed so as to extend over an upper surface of the piezoelectric layer and an upper portion of side faces of the piezoelectric layer, and a protective film is formed above portions of the piezoelectric layer, which are not covered by the upper electrode.

2. The liquid ejecting head according to claim 1, wherein a width of the piezoelectric layer increases toward the lower electrode, wherein a thickness of a portion of the upper electrode formed above the side faces gradually decreases toward the lower electrode, and wherein the protective film is provided so as to overlap with the gradually decreasing thickness portion of the upper electrode.

3. The liquid ejecting head according to claim 1, wherein the upper electrode is configured to cover an upper half portion of each of the side faces of the piezoelectric layer.

4. A piezoelectric element comprising:

a lower electrode formed above a substrate;

a piezoelectric layer formed above the lower electrode; and an upper electrode that covers an upper surface of the piezoelectric layer and an upper portion of side faces of the piezoelectric layer, wherein a protective film is formed above portions of the piezoelectric layer, which are not covered by the upper electrode.

5. A liquid ejecting apparatus comprising the liquid ejecting head according to claim 1.

* * * * *